US005353779A

United States Patent [19]

Lyon

[11] Patent Number: 5,353,779

[45] Date of Patent: Oct. 11, 1994

[54] SELF-CONTAINED CARTRIDGE FOR LAUNCHING A LOW SPEED PROJECTILE

[75] Inventor: David H. Lyon, Belcamp, Md.

[73] Assignee: The United States of Americas as represented by the Secretary of the Army, Washington, D.C.

[21] Appl. No.: 35,866

[22] Filed: Mar. 23, 1993

[51] Int. Cl.[5] ..... F41B 11/06

[52] U.S. Cl. ..... 124/57; 124/56

[58] Field of Search ..... 124/40, 56, 57

[56] References Cited

U.S. PATENT DOCUMENTS

| | | | |
|---|---|---|---|
| 279,539 | 6/1883 | Chamberlain | 124/57 X |
| 2,375,314 | 5/1945 | Mills | 124/57 |
| 2,964,031 | 12/1960 | Dotson | 124/57 |
| 3,142,293 | 7/1964 | Harter | 124/57 |
| 3,830,214 | 8/1974 | Curtis | 124/57 |
| 3,951,037 | 4/1976 | Bornand . | |
| 3,991,682 | 11/1976 | Peak . | |
| 4,220,089 | 9/1980 | Smith . | |
| 4,369,756 | 1/1983 | Gerstenberger et al. | 124/68 |
| 4,493,263 | 1/1985 | Carabateas | 102/483 |
| 5,078,117 | 1/1992 | Cover | 124/57 X |

FOREIGN PATENT DOCUMENTS

| | | | |
|---|---|---|---|
| 2244225 | 7/1993 | Fed. Rep. of Germany | 124/57 |

*Primary Examiner*—Randolph A. Reese
*Assistant Examiner*—John A. Ricci
*Attorney, Agent, or Firm*—Freda L. Krosnick; Frank J. Dynda; Walter R. Baylor

[57] ABSTRACT

Apparatus for a gas charged and initiating mechanism launches a projectile of a relatively low mass at a low velocity. The apparatus has a chamber which has an opening at one end. A burst diaphragm is seated within this opening and seals it. The opening also houses the projectile. A check valve is mounted in an aperture at the opposite end of the chamber. The compressed gas is charged through the check valve. The bursting of the diaphragm is accomplished by a pointed rod protruding from the rear of the projectile or by an electrically-powered squib associated with the diaphragm. The bursting of the diaphragm provides a quick-acting means for releasing the compressed gas whereby the projectile is accelerated down the barrel of a weapon. Additionally, a safety device is mounted within the cartridge for preventing the accidental functioning of the launching projectile.

4 Claims, 7 Drawing Sheets

SELF-CONTAINED CARTRIDGE FOR LAUNCHING A LOW SPEED PROJECTILE

GOVERNMENTAL INTEREST

The invention described herein may be manufactured, used, and licensed by or for United States Government without payment to me of any royalty thereon.

BACKGROUND OF THE INVENTION

1. Field of Invention The present invention relates to a self-contained cartridge for launching a relatively low mass projectile at a low speed. More particularly, the invention relates to an apparatus for a gas charged cartridge and initiating mechanism for launching a light-weight projectile at a low velocity.

2. Description of the Prior Art There are several alternative prior art systems to achieve a low velocity launch of a light-weight projectile. One such system is to use a combustible propellant, such as gunpowder, which generates high-pressure gases upon initiation. These gases-then impinge upon the rear of the projectile to force it down the barrel of a gun weapon. Several types of powders can be utilized in such an application. The modern "smokeless" propellants burn progressively, that is, their burning rate increases as the chamber pressure increases. However, since the chamber pressures encountered when launching a light-weight projectile at a low velocity are far below those required by "smokeless" propellants to burn optimally, the result is a lack of shot-to-shot repeatability. Differing amounts of unburnt propellants are left after the firing event which cause large variations in muzzle velocity and peak pressure. An alternative propellant is "black powder", a substance that burns more consistently at lower pressures- However, black powder is an impact sensitive explosive, and can therefore be very dangerous to handle. Also, black powder produces highly corrosive salts and heavy residue among its combustion products, both of which are detrimental to the life of the weapon.

Compressed gas is also employed to propel projectiles of low sectional density. These systems utilize an initially pressurized vessel, or gas bottle, which is charged with a gas such as $CO_2$. This bottle is used to charge a reservoir internal to the weapon, and then a valve is opened to allow the gas to impinge upon the rear of the projectile. However, these systems are both cumbersome to carry and time-consuming to load. Also, their performance is significantly degraded due to energy losses encountered through the valve, referred to as "valve losses." Furthermore, velocity variations are induced depending on the amount of time between reservoir charging and projectile firing. These are a result of the initial temperature drop undergone by the gas while the reservoir is charged and subsequent heating afterwards, which continuously changes the reservoir pressure. In addition, chamber pressures vary due to the pressure left in the bottle, especially if used for multiple shots.

Another system of projectile propulsion utilizes compressed ambient air. There are two basic means of operation; namely, pump or spring-air. The pump type uses a piston with a one-way valve which allows an internal reservoir to be charged. The pressure depends on how many times the manually operated lever is actuated. This system is subject to the same type of valve losses as mentioned above. Also, since the air is heated during the compression process, the reservoir pressure changes as the air cools. The spring-air type employs a compression spring which pushes a piston inside of a cylinder. The spring is compressed manually and is released with trigger pull. It then forces the piston to compress ambient air which is communicated directly to the rear of the projectile. This system provides better shot-to-shot repeatability than the previous systems. However, this type can only be used in a single shot mode, requiring the spring to be manually recompressed for each shot. Also, as the caliber of the weapon and the mass of the projectile increases, so must the spring force needed to achieve similar performance. Therefore, the spring quickly becomes too stiff for an operator to compress, even utilizing leverage.

3. Advantages over the Prior Art

The present invention relates to an apparatus for a gas charged cartridge and initiating mechanism for launching a projectile of a relatively low mass at a low velocity (less than 300 m/s). Apparatus of this type is useful for propelling a non-lethal projectile such as a hypodermic dart or throwing of a line from ship to ship. The cartridge itself is a reservoir which is charged with compressed air. The reservoir is sealed on the end facing the projectile with a burst diaphragm (or a rupture-type disk). The apparatus also incorporates a means of rupturing the diaphragm. The rupturing is accomplished by either a rupture rod attached to rear of the projectile or by an electric squib associated with the diaphragm. During firing, the diaphragm is punctured, quickly releasing compressed gas to propel the projectile forward down the barrel of a gun weapon.

The apparatus of the present invention has a number of advantages over the prior art. First, the apparatus provides a means of launching a relatively low mass projectile at a highly consistent velocity. Second, the apparatus performs its operation in a highly efficient manner since its use of a diaphragm virtually eliminates both valve and pipe losses. Third, the apparatus uses a relatively small, one-piece package which requires no accessory or ancillary equipment, such as a gas bottle. Fourth, the apparatus allows for long term storage under harsh ambient conditions, while not requiring any special maintenance or care to retain its original performance. Fifth, the apparatus lends itself for use as a single-shot weapon, a semi-automatic weapon, or a fully-automatic weapon. Lastly, the cartridge and launcher apparatus is of low cost due to its simplicity and low operating pressures.

SUMMARY OF THE INVENTION

The present invention relates to an apparatus for a gas charged cartridge and initiating mechanism for launching a projectile of a relatively low mass at a low velocity.

Accordingly, it is an object of the present invention to provide a self-contained cartridge for launching a light weight projectile at a low speed.

Other objectives of the present invention will be apparent from the following detailed description of the invention.

BRIEF DESCRIPTION OF THE DRAWINGS

The foregoing and other objects, aspects, uses, and advantages of the present invention will be more fully appreciated as the same becomes better understood when considered in connection with the following accompanying drawings which.

DESCRIPTION OF THE INVENTION

Figure 1:
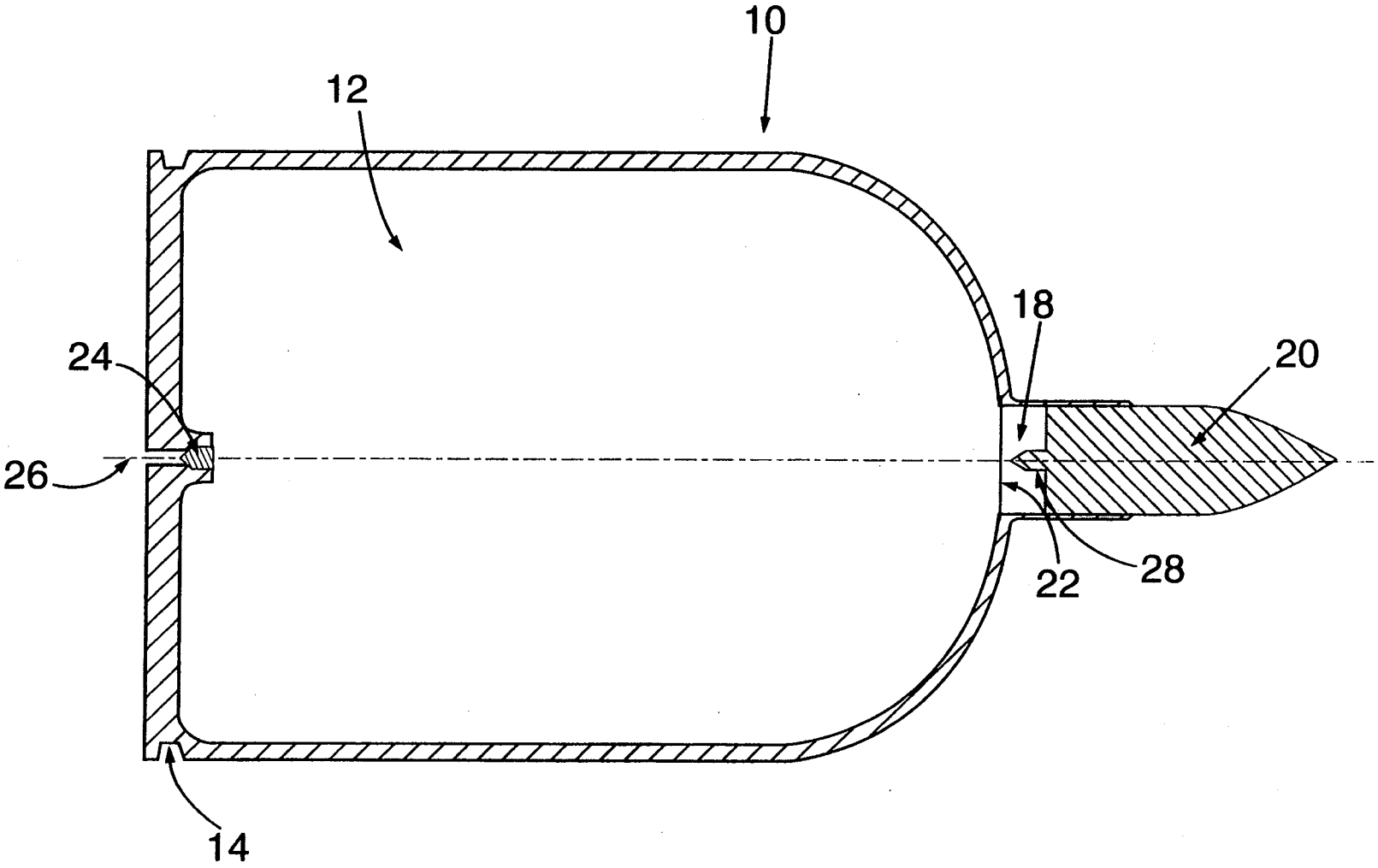
FIG. 1 is a cross sectional side view illustrating a cartridge according to the present invention.

Referring now to the drawings, like reference numerals represent identical or corresponding parts throughout the several views.

In FIG. 1, a cartridge case 10 is a pressure chamber 12 for holding compressed gas. The cartridge case 10 is constructed of metal, such as brass or steel, or a high strength synthetic material, preferably reinforced with fibers. It is fabricated in as few pieces as possible, the preferred embodiment being an unitary structure, for simplicity and to reduce the possibility of gas leakage. The compressed gas is charged into the cartridge case 10 which may remain entirely in the gaseous state or may be compressed partially or fully to the point of liquification over the expected ambient operating conditions. If any liquid is present in the charged case, the pressure drop it will experience during projectile launch will allow it to return to the gaseous state for maximum efficiency. The shape of the cartridge 10 can vary depending upon the maximum pressure and projectile type as well as the optimized strength and flow geometries. In the embodiment shown, the cartridge 10 has an extractor groove 14 to assist in removing the cartridge 10 from a launching gun weapon 16, (see FIG. 2). Thus, the cartridge design allows removal, either manually or by an automatic means, utilizing the extractor groove 14. At one end of the cartridge 10 there is an opening or mouth 18 which is designed to receive a projectile 20 in a close fitting manner. Behind the projectile 20 in a seating location is a burst diaphragm or rupture disk 22 usually constructed of metal or plastic, which spans and seals the bottom of the opening 18. The diaphragm 22 is either molded integral to the cartridge 10 or attached, for example, by an adhesive or heating means. After fabrication, the cartridge 10 is charged with the compressed gas. This can be accomplished by any one of several methods. In FIG. 1 a one-way valve or check valve 24 is employed to allow the interior of the cartridge 10 to be charged with the gas and to prevent the gas from escaping through a charge aperture 26. The aperture 26 can be sealed by a more permanent means after charging to reduce the risk of leakage- The projectile 20 is seated within the opening 18 using a tight fit, crimp, or adhesive construction. This type of construction provides sufficient force to restrain movement of the projectile 20.

Figure 2:
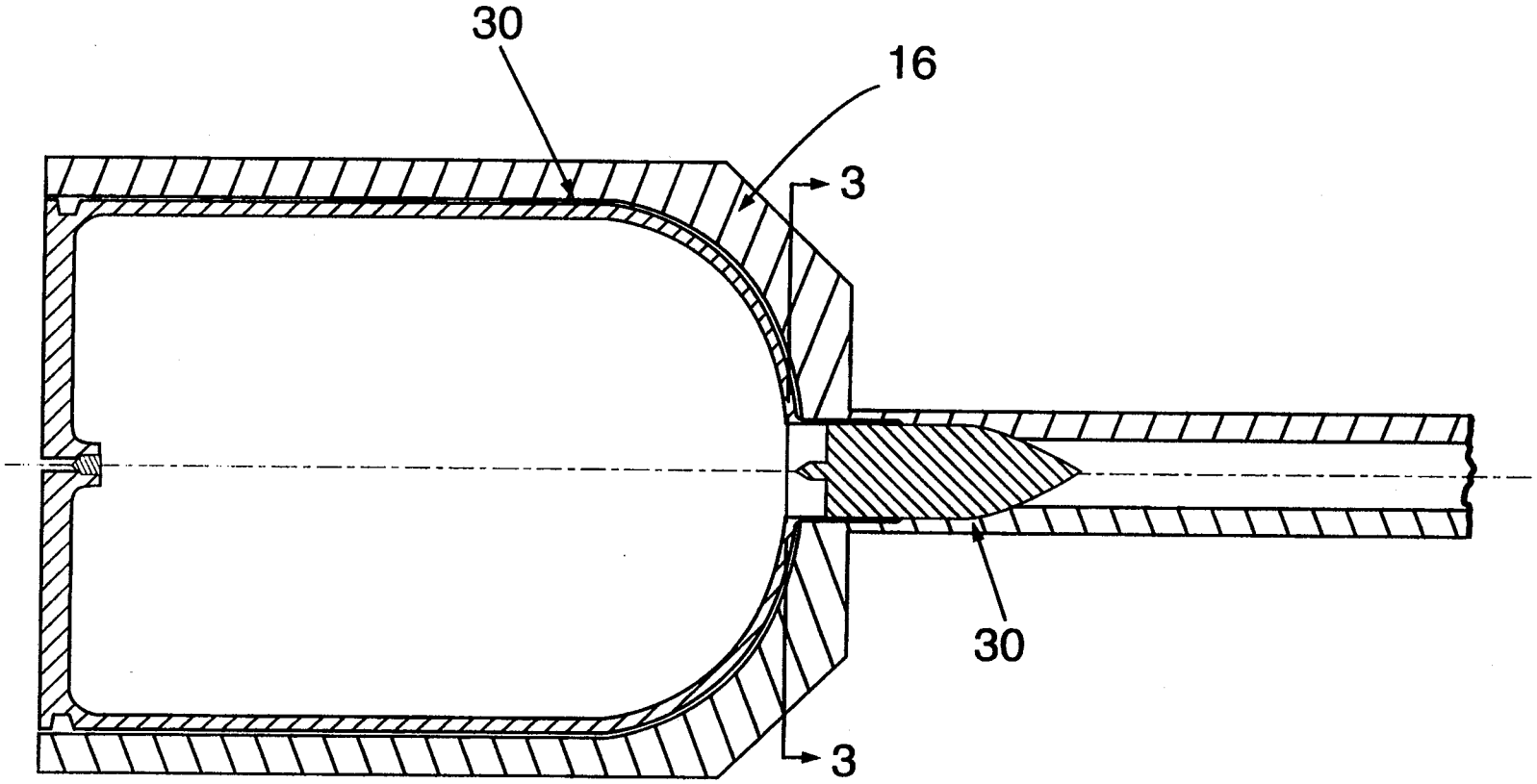
FIG. 2 is a cross sectional side view illustrating the cartridge inserted into a launching projectile.
Figure 3B:
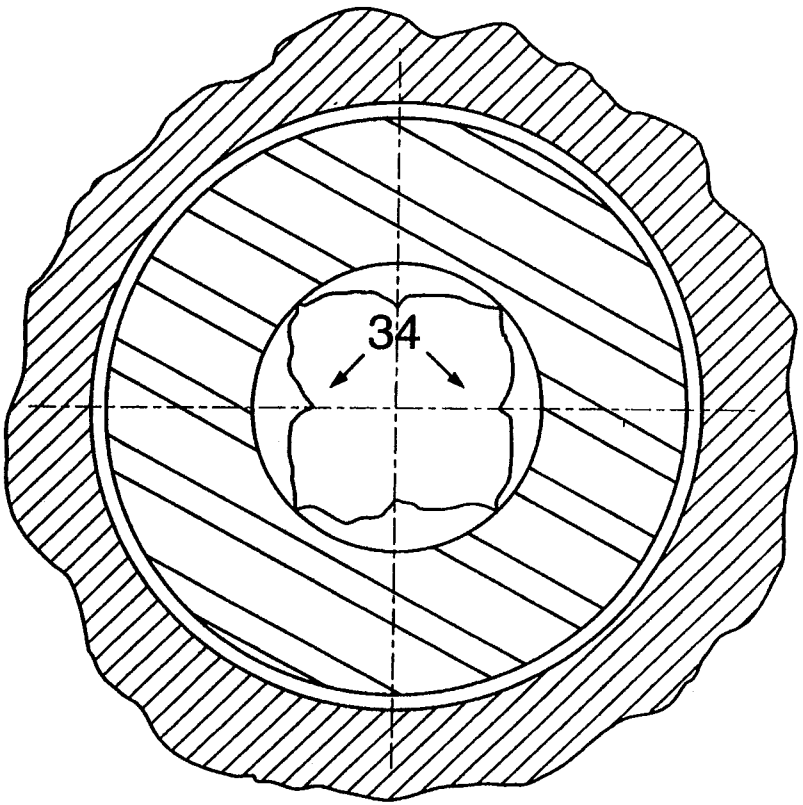
FIG. 3*b* is a similar view to FIG. 3*a* illustrating the pieces of the burst diaphragm.
Figure 3A:
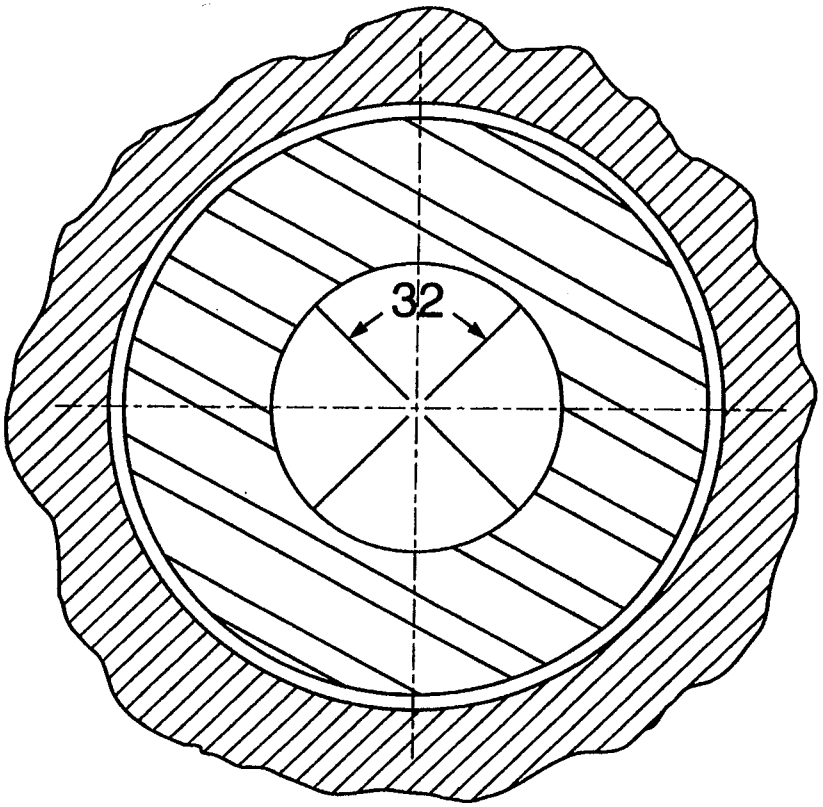
FIG. 3*a* is a cross sectional view taken along line 3—3 of FIG. 2 illustrating pre-engraved grooves of a diaphragm mounted within the cartridge.

In one method of operation, the projectile 20 has incorporated into its rear portion, a device capable of bursting or rupturing the diaphragm disk 22 when it is operationally pushed into contact with the projectile 20. The preferred form of rupturing is a pointed rod or pin 28 protruding from the rear portion of the projectile 20 and it is called a bursting pin. Referring to FIG. 2, a barrel 30 of the launching weapon 16 is designed to allow the cartridge 10 to fit freely however, the projectile 20 is slightly oversized compared to the forcing cone of the barrel 30. The mismatch in sizes is such that as the cartridge 10 is chambered into the barrel 30, the projectile 20 is forced back towards the diaphragm 22. As the cartridge 10 is fully chambered, the bursting pin 28 comes into contact with the diaphragm 22 with sufficient force to cause the diaphragm 22 to burst. Upon bursting, the diaphragm 22 tears and bends, possibly along a series of pre-engraved radial grooves 32 of FIG. 3*a*, until its pieces 34 of FIG. 3*b* come to rest against the walls of the barrel 30. This provides an extremely quick-acting means to release the compressed gas which will then accelerate the projectile 20 down the barrel 30.

Figure 4:
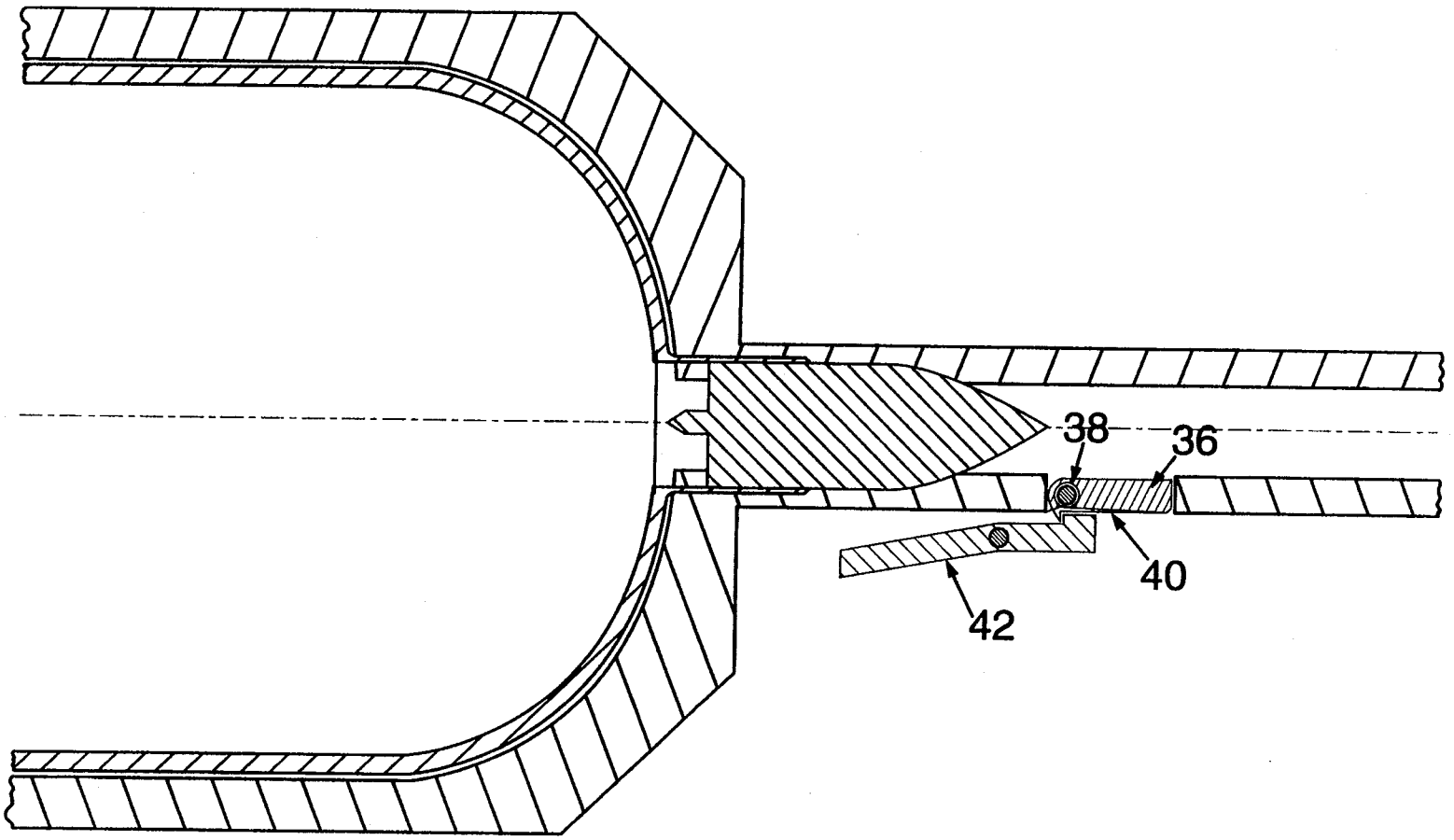
FIG. 4 is a cross sectional side view of the cartridge-projectile unit illustrating a spring-biased pivotally mounted hammer.
Figure 5:
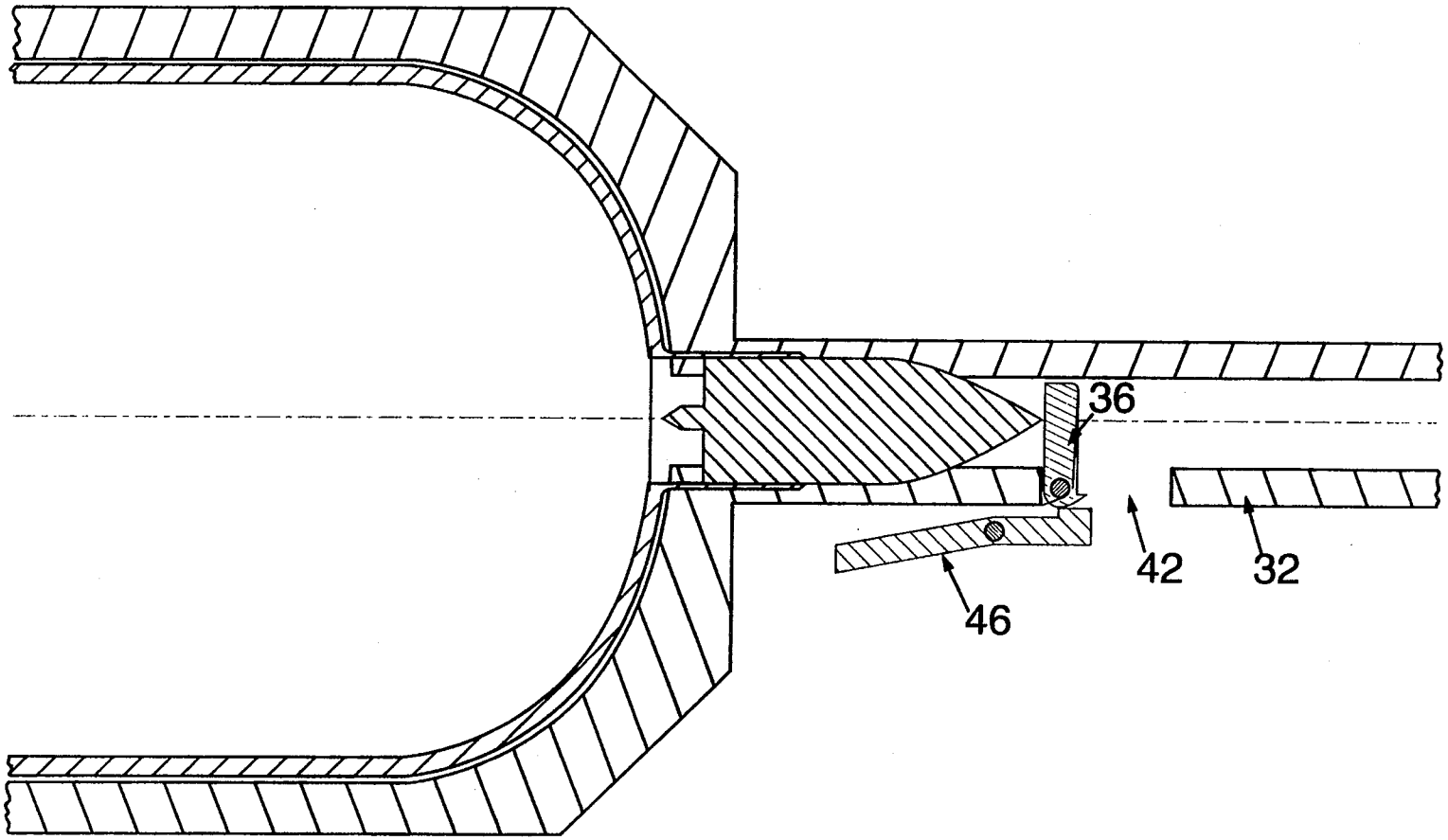
FIG. 5 is a partial cross sectional side view illustrating the pivoted hammer the nose of the projectile.

An alternative launcher modification, depicted in FIGS. 4 and 5, allows the complete unit of the cartridge 10 and projectile 20 to fully seat in the chamber 12 with a free fit. A pivotally mounted hammer 36 under spring tension is positioned forward of the projectile 20 to swing upwardly through a slot 40 in the barrel 30 so it will strike the nose of the projectile 20. The projectile 20 is struck with sufficient force to drive it back into the cartridge 10 a sufficient distance to puncture the diaphragm 22. The hammer 36 is released through a sear mechanism 42 with trigger pull and can be automatically recocked as the projectile 20 moves forward, passes over the slot 40 and depresses the hammer 36.

Figure 6:
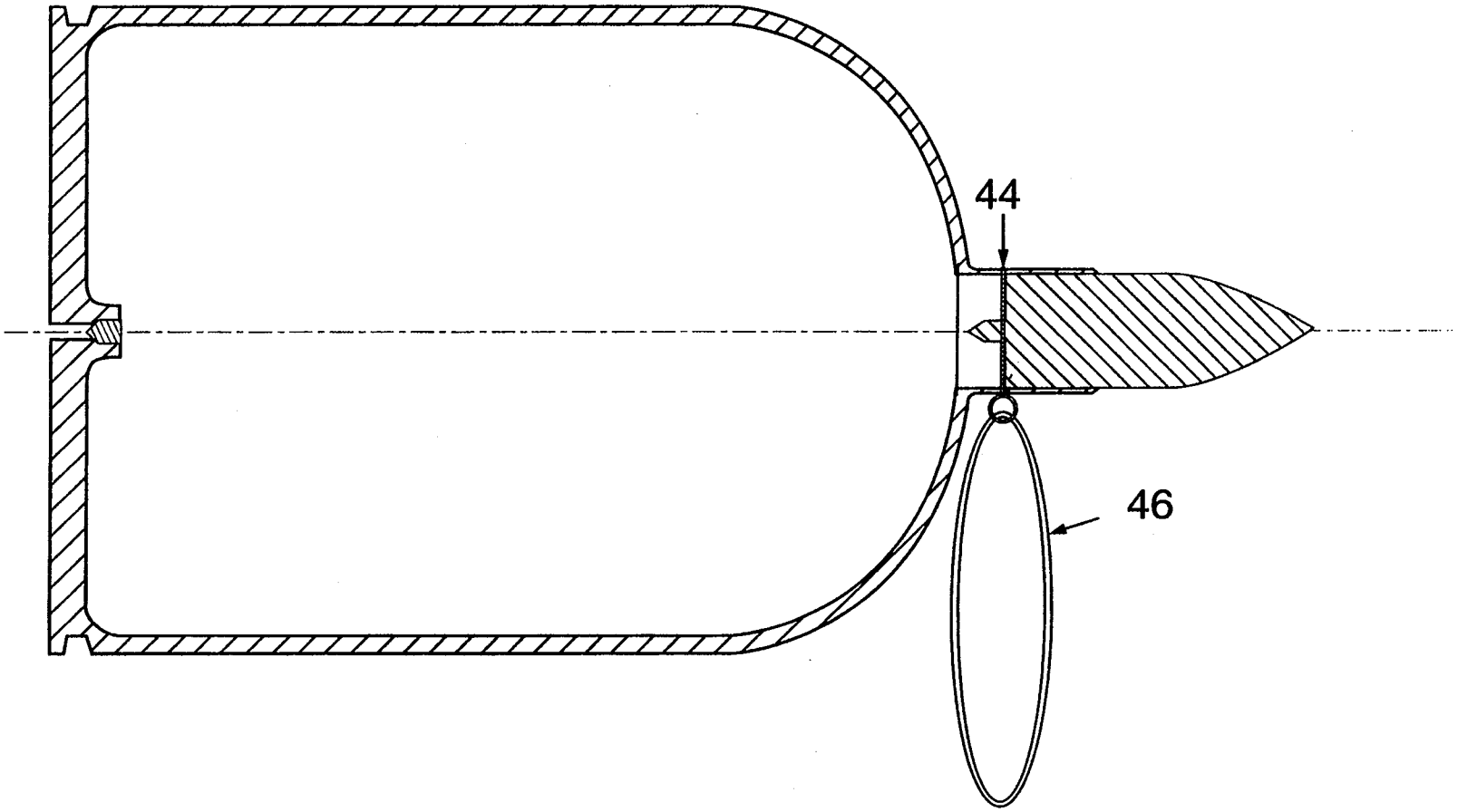
FIG. 6 is a cross sectional side view of the cartridge-projectile unit illustrating a safety device.

The cartridge 10 may incorporate a safety device to prevent accidental functioning. Referring to FIG. 6, the safety device is shown as a transverse pin 44 and a removal assist member 46, both of which would be removed prior to chambering the cartridge 10. This safety feature would also prevent release of the projectile 20 due to an accidental rupture of the diaphragm 22.

Figure 7:
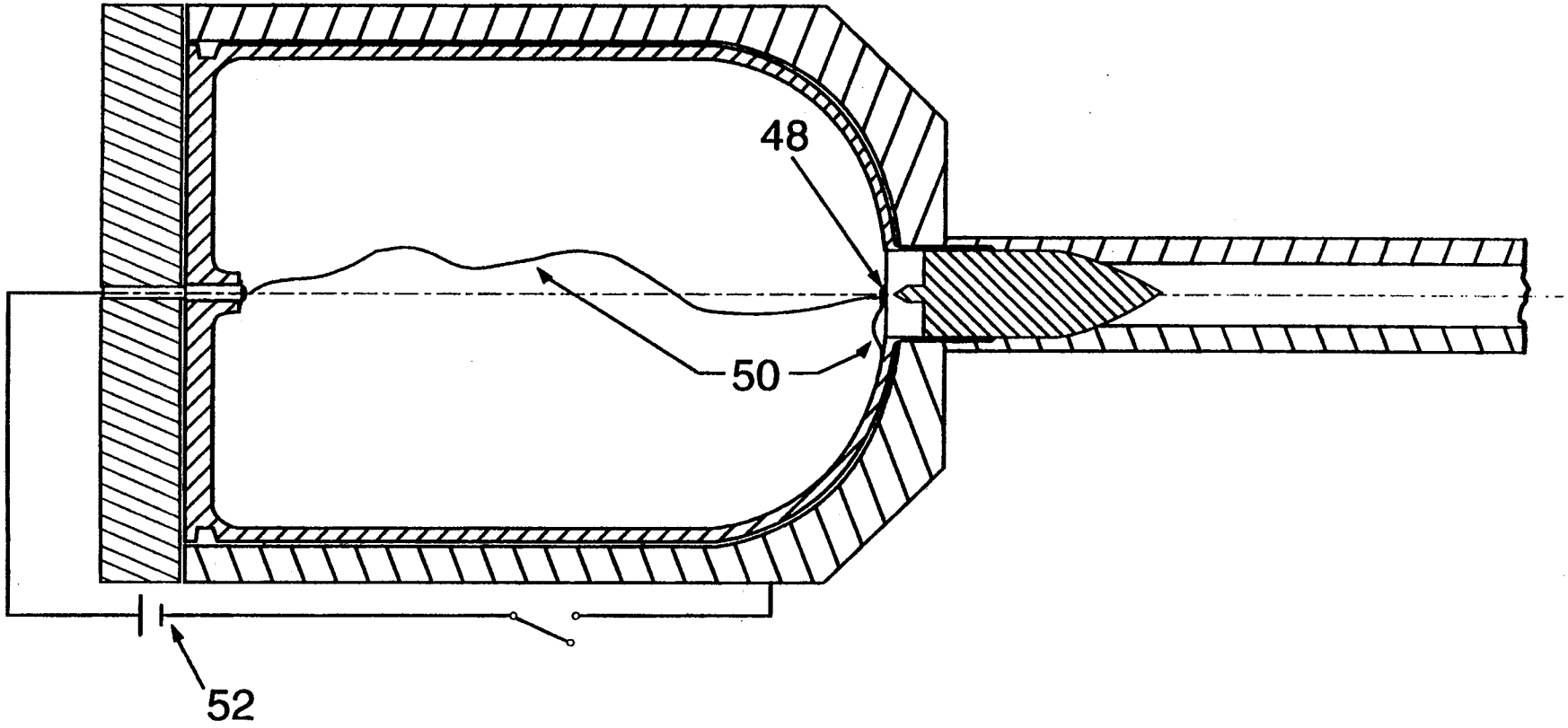
FIG. 7 is a cross sectional side view of the cartridge-projectile unit illustrating a firing circuit.

FIG. 7 shows an alternate cartridge modification. An electrically initiated squib 48 is attached to the rear of the diaphragm 22, with electrical leads 50 communicating through the cartridge 10 to a battery 52. The battery 52 which is housed within the launching weapon 16 provides, when a trigger is pulled, a firing impulse to the squib 48. Initiation of the squib 48 ruptures the diaphragm 22 and allows the compressed gas to escape and to propel the projectile 20 down the barrel 30.

An example of the operation of the launching system according to the invention is as follows:

A first order approximation which yields general performance data can be calculated after making several assumptions. Assume an ideal gas and an adiabatic expansion (no losses):

$$\rho V^{\gamma} = \text{Constant}$$

Also assume a vacuum in the barrel ahead of the projectile and neglect any friction between the projectile and the bore. Lastly, define the breech pressure and projectile base pressure to be identical, a valid approximation for a low velocity, expanding gas. Evaluation of the following integral, along with the included initial conditions, will yield the work done on the projectile during gas expansion:

$$\text{Work} = \int_{V_1}^{V_2} p\,dV = \frac{p_2 V_2 - p_1 V_1}{1-\gamma}$$

$$\text{Kinetic Energy} = \frac{1}{2} m V^2$$

Projectile Mass (m) = 0.1 kg
Bore Diameter = 0.02 m
Barrel Length = 0.5 m
Initial Pressure ($p_1$) = $6.89 \times 10^{+6}$ N/m$^2$
Chamber Volume ($V_1$) = $1.53 \times 10^{-3}$ m$^3$ The result is 1139J of energy imparted to the projectile. Equating this to the kinetic energy of the projectile provides a muzzle velocity of 151 m/s. Therefore, this first order approximation validates the apparatus feasibility; however, it should yield a somewhat overpredicted muzzle velocity due to the no-friction assumption.

To those skilled in the art, many modifications and variations of the present invention are possible in light of the above disclosure. For example, the projectile type and shape can vary as well as its method of stabilization. It may be a spin stabilized projectile which would engrave itself into rifling in the barrel or it may be aerodynamically stabilized, employing fins, cones, or other lifting surfaces to achieve a non-spinning stabilization. It may also be a sub-caliber projectile supported while in the barrel by a sabot. It is therefore to be understood that the present invention can be practiced otherwise than as specifically described herein and still will be within the spirit and scope of the appended claims.

What is claimed is:

1. Gun weapon apparatus for a gas charged cartridge for launching a projectile of a relatively low mass at a low velocity, comprising in combination:

a chamber having an opening at one end, a diaphragm means seated within the opening, the opening also adapted to receive said projectile, vale means mounted in an aperture at the opposite end of the chamber for permitting the charging of the chamber with compressed gas and also for preventing the gas from escaping through the aperture, means for interacting with the diaphragm means for releasing the compressed gas whereby the projectile is accelerated through a barrel of said gun weapon wherein the interacting means includes a spring-biased pivotally mounted hammer being operationally releasable through a sear mechanism upon the activation of the gun weapon whereby the hammer strikes the nose of the projectile for forcing it in a backward direction toward said diaphragm to rupture the diaphragm means.

2. Apparatus as defined in claim 1 including a safety means comprising a transverse pin member and a removal assist member, wherein said transverse pin member prevents motion of said projectile with respect to said cartridge.

3. Apparatus as defined in claim 1 or 2 wherein said interacting means includes an electrically-powered squib means mounted on the pressurized side of said diaphragm means providing a firing impulse for rupturing said diaphragm.

4. Gun weapon apparatus for a gas charged cartridge for launching a projectile of a relatively low mass at a low velocity, comprising in combination:

the cartridge having an opening at one end, p1 a diaphragm seated within the opening and sealing it, the opening also adapted to receive the projectile, a one-way check valve mounted in an aperture at the opposite end of the cartridge for permitting the charging of the cartridge with compressed gas and also for preventing the gas from escaping through the aperture, the diaphragm being a rupture-type disk having a series of radial pre-engraved grooves, and means for rupturing the grooved disk including a pointed rod protruding from the rear of the projectile and pointing towards said diaphragm, the pointed rod rupturing the grooved disk said pointed rod being forced toward the diaphragm of said cartridge as the cartridge is chambered into a gun barrel wherein the compressed gas being released propels the projectile through the barrel of the gun weapon.

* * * * *